US006698259B2

(12) United States Patent
MacMillan

(10) Patent No.: US 6,698,259 B2
(45) Date of Patent: Mar. 2, 2004

(54) DUAL ACTION DETENT FOR TAMPER RESISTANT LEVER LOCK MECHANISM

(76) Inventor: Daniel MacMillan, 1290 E. Jamison Ave., Littleton, CO (US) 80122

( * ) Notice: Subject to any disclaimer, the term of this patent is extended or adjusted under 35 U.S.C. 154(b) by 0 days.

(21) Appl. No.: 09/864,566

(22) Filed: May 24, 2001

(65) Prior Publication Data

US 2002/0174696 A1 Nov. 28, 2002

(51) Int. Cl.[7] ..... E05B 25/02
(52) U.S. Cl. ..... 70/134; 70/355; 70/419
(58) Field of Search ..... 70/134, 419, 348–355

(56) References Cited

U.S. PATENT DOCUMENTS

| | | | | | |
|---|---|---|---|---|---|
| 165,995 | A | * | 7/1875 | Goldfinger | |
| 303,183 | A | * | 8/1884 | Parker et al. | |
| 303,498 | A | * | 8/1884 | Demming | |
| 317,076 | A | * | 5/1885 | Becht | |
| 619,524 | A | * | 2/1899 | Warner | |
| 1,084,082 | A | * | 1/1914 | Grandits | |
| 1,756,342 | A | * | 4/1930 | Carlin | |
| 2,067,319 | A | * | 1/1937 | Haag | |
| 2,436,628 | A | | 2/1948 | Bratschi | 70/55 |
| 2,963,897 | A | * | 12/1960 | Dupere | |
| 3,879,968 | A | | 4/1975 | Schweizer et al. | 70/81 |
| 4,182,145 | A | * | 1/1980 | Tippin et al. | 70/134 |
| 4,506,530 | A | | 3/1985 | Robinson et al. | 70/338 |
| 4,691,545 | A | * | 9/1987 | Pagano | 70/352 |
| 4,739,639 | A | | 4/1988 | Balasingam | 70/355 |
| 4,907,431 | A | * | 3/1990 | Mauer | 70/355 |
| 5,560,234 | A | | 10/1996 | Ross et al. | 70/352 |
| 6,434,981 | B2 | * | 8/2002 | Fantl et al. | 70/25 |

FOREIGN PATENT DOCUMENTS

| | | | | |
|---|---|---|---|---|
| DE | 1189406 | * | 3/1965 | 70/134 |
| DE | 1250761 | * | 9/1967 | 70/134 |
| DE | 2932471 | * | 2/1981 | 70/134 |
| GB | 690247 | | 4/1953 | |
| GB | 890124 | | 2/1962 | |
| GB | 968635 | * | 9/1964 | 70/134 |
| GB | 2 008 661 | | 6/1979 | |
| GB | 2 121 468 | | 12/1983 | |

OTHER PUBLICATIONS

"Complete Course in Professional Locksmithing" by Robert L. Robinson, Professional/Technical Series, Nelson–Hall Co., Chicago, IL.
"The Story of Keys and Locks" by John Stephen, Sterling Publishing Co., Inc., New York, NY.
"The Complete Handbook of Locks & Locksmithing" by C.A. Roper, Tab Books, Inc., Blue Ridge Summit, PA.
Excerpt from "Locks, Picks, and Clicks" published by Paladin Press, Boulder, CO.

* cited by examiner

*Primary Examiner*—Lloyd A. Gall
(74) *Attorney, Agent, or Firm*—Merchant & Gould P.C.

(57) ABSTRACT

A lever lock apparatus having a sliding bolt, a detent mechanism for locking the bolt against sliding movement and a plurality of levers. When using the appropriate key, the detent moves to allow the bolt to be slid to a locked or unlocked position. When the lock is under attack, and an inward force is applied to the bolt, the detent moves so as to maintain a detent fence away from the levers. Keeping or moving the fence away from the levers impairs the ability to pick or otherwise attack the lock.

15 Claims, 15 Drawing Sheets

DUAL ACTION DETENT FOR TAMPER RESISTANT LEVER LOCK MECHANISM

BACKGROUND OF THE INVENTION

1. Field of the Invention

The present invention relates generally to lever locks and more particularly, the present invention relates to detents for use with such mechanisms.

2. Description of the Prior Art

Lever locks have been used for some time in a wide variety of applications and situations to lock and secure doors, gates, safety deposit boxes, and the like. Lever locks typically comprise a sliding bolt mechanism. When the bolt is extended outwardly from the case in which it is housed, it typically engages into a hole or mortise in a doorjamb or other fixed member. The bolt is thrown from side to side by way of a portion of an inserted key. As the key turns, the bit end of the key usually contacts the bolt and causes it to slide from side to side as the key is turned.

The lever lock incorporates a plurality of swinging detainers, i.e., a plurality of plate-like levers which swing up and down, or side to side, typically under the force of a spring which biases the levers into a locking position. The key is specifically designed to move or raise these different levers to unique but varying positions or heights such that when the levers are in a particular combination or configuration of heights, a detent is able move due to an external force such as gravity or more typically by a spring force into a specific position. Once in that specific position the detent releases the bolt mechanism allowing it to freely slide into locking or unlocking engagement with the mortise. Typically levers include openings or recesses known as "gates" which are aligned so that a portion of the detent actually slides into the gates of the levers to free the movement of the bolt. The portion of the detent that slides into the gates is known as a fence.

Other lever locks do not use a detent, but instead have the fence connected to the bolt itself. Once the levers are properly aligned, the fence is free to move, thus allowing movement of the bolt.

Three common methods used to defeat lever locks include picking, impressioning and fence breaking. All these methods rely on the ability of the attacker to control the amount of pressure the fence exerts against the levers. The pressure is usually caused using a pick wherein pressure applied to the pick is transferred to pressure of the fence against the levers. As an example, the pressure may be exerted on the fence through the keyhole using a special pick tool that turns the cam, which in turn exerts pressure on the bolt which transfers pressure to the detent, and hence, the fence.

In picking, the pressure of the fence against the levers holds the levers in position while other levers are individually raised to their respective "unlocked" position, i.e., a position where all lever gates are properly aligned to allow the fence to move. In impressioning, a large pressure causes levers that are not at a gate to leave a mark on the key being cut. In fence breaking, a substantial pressure is exerted on the bolt, typically using a crowbar or similar tool, causing the fence to actually break thus allowing the lock to open.

Previously, locks have been constructed that were intended to be pick or tamper resistant. For example, locks have been designed to incorporate false gates, jagged-edged levers/fences, detector levers, a spring to compress the stack of levers, a tail on a monitor lever, among others in an attempt to make the above described tamper techniques more difficult. Yet in every design, the attacker still has control over the amount of pressure exerted by the fence against the levers. Hence, while the above methods of attack are made more difficult by these improvements, they are still possible.

For example, in one prior-art lock, a "detector lever" is used to resist tampering. In such a lock, the detector lever is designed to be "caught" by a spring if it is raised too high. This prevents any further tampering with the lock, as the lock will not open until the detector lever is "released." Unfortunately however, this does not completely prevent picking of the lock by the usual method, instead it only interrupts the picking process when a lever is raised too high.

In another prior-art lock, the tail on a "monitor lever" is used to foil would-be attackers. In this case, the tail of the monitor lever covers a portion of the keyhole when the lever is raised which makes it difficult to insert the lock picking tools. The tail however, does not directly affect the lock picking process. Similarly, in yet other lock designs, such as locks that use false gates and jagged edges, the features make it difficult to keep the levers in alignment, but do not completely avert picking and do not affect impressioning or fence breaking.

It is with respect to these and other considerations that the present invention has been made.

SUMMARY OF THE INVENTION

The present invention relates to a lever lock apparatus having a detent which removes or limits an attacker's ability to control the amount of force exerted by a fence against the levers. More specifically, when a force is applied to the bolt, the fence of the present invention is forced away from the levers. In essence, the present invention relates to a lever lock apparatus having a detent that performs differently when the lock is being tampered with than when the lock is operated using the correct key. This dual-acting detent swings toward the levers when using the correct key thus allowing the lock to open. However, when an attempt is made to defeat the lock, the detent swings away from the levers preventing the lock from opening and hindering the attempts to defeat the lock.

An aspect of the present invention relates to the directional forces applied to a detent causing both movement to open the lock and movement to prevent the lock from being attacked.

In accordance with other preferred aspects, the present invention relates to lever-lock levers that have frictional components that are much greater than the friction of the fence against the lever end. In order to achieve higher frictional components, i.e., those components other than the fence/lever friction component, the plate faces are roughed or the spring constants can be adjusted to increase the lever frictional components. Additionally, the fence/lever frictional component may be lowered using polished surfaces, rounded edges, lubrication or a reduced spring-biasing force. In preferred embodiments, the amount of possible force exerted by the fence on the levers is insufficient for impressioning and fence breaking.

The invention may be embodied in a key actuated lever lock housed in a case adapted to be mounted in or on a door, gate or the like. Alternatively, the invention may be incorporated into a padlock. The lock includes a bolt housed in the case and adapted to be thrown between a locking position and an unlock position by a thrower mechanism.

The bolt has a bolt head adapted for locking engagement in a mortise and a bolt tail plate extending from the bolt head. The tail plate has a bottom edge and defines a notch extending into the plate and opening into the bottom edge. The notch defines opposed talons integral with the tail plate. A recessed area is formed in the tail plate above the talons, and is bounded by internal edges including a recessed bottom edge. The plate further defines a pair of spaced notches opening into the recessed bottom edge that are separated by an upwardly projecting dovetail boss having downwardly and inwardly sloping side edges. An L-shaped detent is pivotally mounted on a detent pivot in the case and defines an arm having a cam rider formed thereon at the lower end thereof. A detent cam is rotatably mounted in the case. A spring biases the detent to hold the cam rider against the detent cam. The detent further defines an elongated laterally extending tail having an upper edge, with a trapezoidal stump integral with the laterally extending detent tail and extending laterally from the upper edge of the tail and defining opposed downwardly and outwardly sloping surfaces.

The stump is adapted to be selectively received in one of the spaced notches, with a sloping edge of the stump in interference engagement with a corresponding sloping edge of the boss.

A key actuated swinging tumbler thrower mechanism is provided for rotating the detent cam to release the detent for spring biased pivoting movement about the detent pivot to release the stump from engagement with the boss and for engaging the talons to throw the bolt when the proper key is used. When the proper key is not used, and a force is applied to the bolt in the unlock direction, the shape of the boss acts on the stump to exert a force on the detent tail urging the detent arm away from the cam and levers thereby thwarting efforts to unlock the lock without a key.

DETAILED DESCRIPTION

Figure 1:
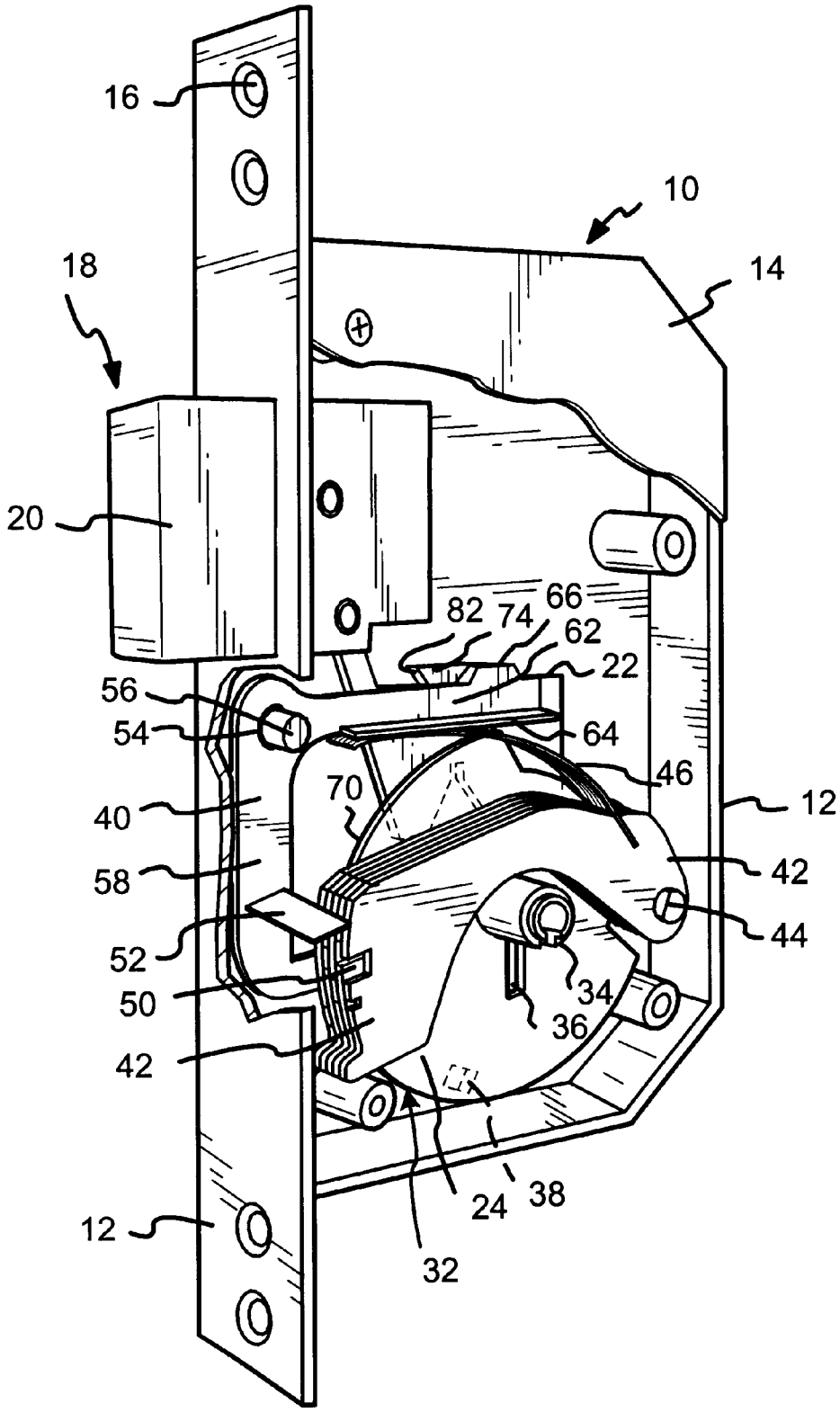
FIG. 1 is a perspective view of a lock embodying the present invention with a part of the lock case removed.
Figure 2:
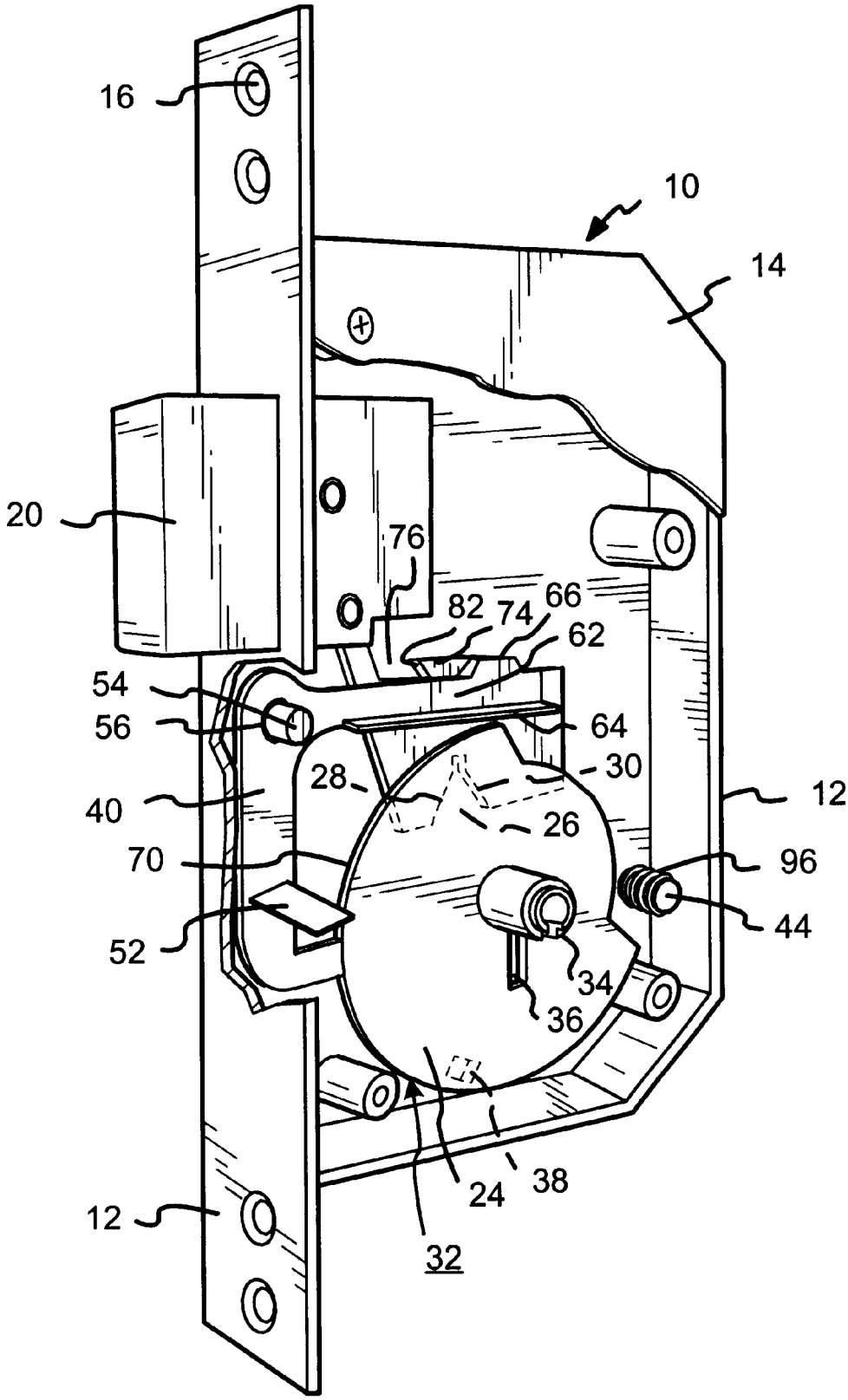
FIG. 2 is a perspective view similar to FIG. 1 with the levers or detainers removed for clarity of illustration.

The present invention is embodied in a key actuated lock mechanism 10 housed in a case 12 having a face plate 14, as shown in FIGS. 1 and 2. The case 12 is adapted to be inserted in an appropriately sized recess in one edge of a door panel (not shown) and secured therein by screws (not shown) extending through screw holes 16 in the case 12 into engagement with the edge of the door. Alternatively, the lock could be attached to the face of the inside of a door.

Figure 3:
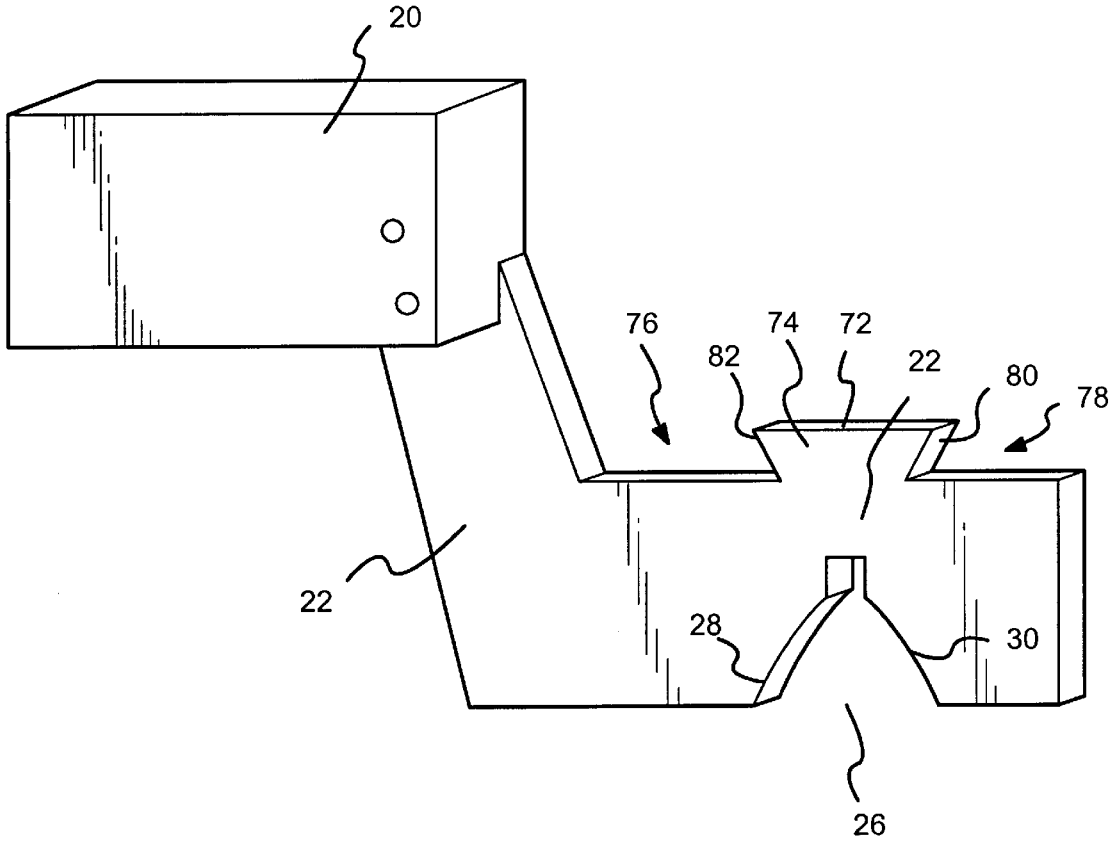
FIG. 3 is a perspective view of the bolt of the lock shown in FIG. 1.

The key actuated lock mechanism 10 is of the type commonly referred to as a lever tumbler or detainer lock mechanism and includes a sliding bolt 18, having a bolt head 20 adapted to be extended into or drawn from a mortise in a doorjamb (not shown), and a plate-like bolt tail 22 integral with or secured to the bolt head 20 and extending into the case 12. The bolt 18 is shown in FIG. 3 apart from the remaining components for clarity.

The bolt head 20 is thrown or drawn into a locking or unlocking position by a key-operated detent cam 24 which operatively engages the bolt tail 22. For the purposes of operative engagement with the cam 24, the bolt tail 22 defines an inverted V-shaped downwardly opening notch 26 (shown in FIG. 3), the sloping edges 28 and 30 of which form talons or shoulders engageable by the cam 24 to slide the bolt 18, as discussed in more detail below.

The cam 24 is formed as part of a thrower plate 32 which has an axially extending support sleeve or stem 34 secured thereto and defining a key slot 36. The case walls 14 define key holes (not shown) corresponding to the key slot 36 in the stem 34.

For operatively engaging the bolt tail 22, the cam plate 32 defines a radially projecting thrower 38. As the cam plate 32 is rotated by a key inserted in the key slots, the thrower 38 enters the downwardly opening notch 26 on the tail plate 22 and engages a talon 28 or 30, depending on the direction of rotation of the cam plate 32. Further rotation of the key and cam plate 32 causes the thrower 38 to cammingly engage a talon 28 or 30 and force the bolt 18 to slide or shoot in the desired direction. This motion is discussed in more detail in conjunction with FIGS. 4A–4C below.

The operation of the cam 24 and the bolt 18 is lockingly controlled by a detent 40 in operative association with lever tumblers or detainers 42. The lever tumblers or detainers 42 comprise a plurality of plate-like levers or detainers (hereinafter, "levers") swingably mounted on a lever pivot pin 44 mounted in the case 12. Each lever 42 is individually biased in a counter-clockwise direction by a leaf spring 46 acting between the lever 42 and a spring support 64 mounted on the detent 40. In this manner, each lever 42 is independently movable or swingable in an arc about the axis of the lever pivot pin 44.

Each lever 42 defines a detent receiving slot, notch or "gate" 50 on its forward edge. To align the various gates 50 into detent receiving position, i.e., to receive a fence portion 52 of the detent 40, the levers 42 are pivoted by engagement with projecting teeth on the bit of a key (not shown) designed to open the lock 10. When the gates 50 are in alignment, the fence 52 projecting laterally from a pivotally mounted detent 40 drops into the aligned gates 50 allowing the detent 40 to swing and release the bolt 18.

Figure 5A:
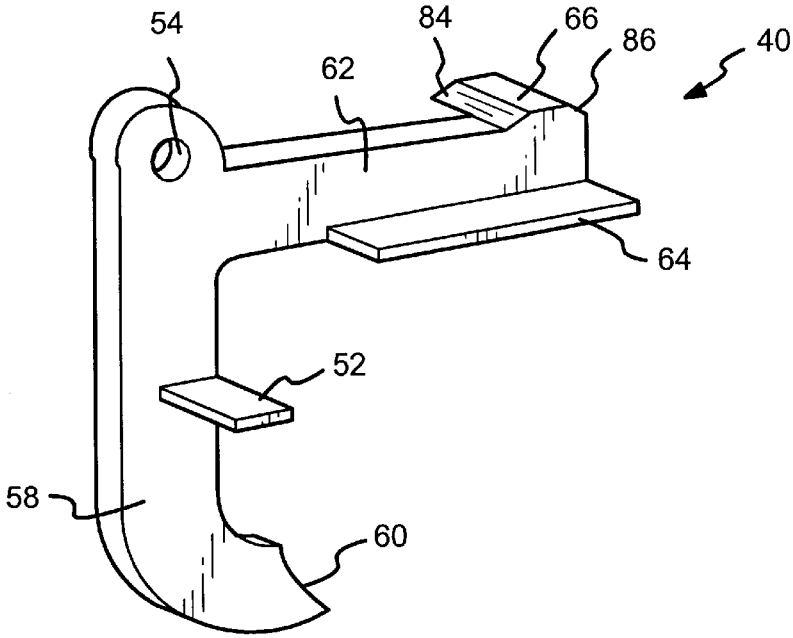
FIG. 5A is a perspective view of the detent of the lock shown in FIG. 1.

In the embodiment shown in FIG. 1, the detent 40 is a generally L-shaped piece, and is pivoted at its apex 54 on a pivot pin 56 mounted in the case 12. The detent 40 (also shown in FIGS. 5A and 5B) includes a depending arm 58 terminating at its lower end in a cam follower or rider 60 (FIG. 5A). The fence 52 extends laterally therefrom between the pivot pin 56 and the cam rider 60. In alternative embodiments discussed below in conjunction with FIGS. 7 and 8, the detent does not necessarily have to be L-shaped.

The detent 40 further defines an elongated, laterally or horizontally extending tail 62. It is engaged by biasing springs 46 that contact a shelf-like protrusion 64 of the tail 62. The detent 40 also has a laterally extending stump 66 adapted to extend into locking engagement with the bolt tail 22. The springs 46 bias the detent 40 in a counter-clockwise direction (as shown) about pin 56 to urge the detent 40 into its unlocking position by biasing the arm 62 upward (as shown). Alternatively, a spring 68 (FIG. 5B) may also be used on its own or in combination with springs 46 to bias the detent 40 into its unlocking position. The detent 40 is held in a locking position by the engagement of the cam rider or follower 60 on its depending arm 58 with a cam surface or edge 70 of cam 24.

In order to provide for operative engagement between the bolt tail plate 22 and the detent 40 either to lock the bolt 18 against being drawn or thrown or released, the tail plate 22 has an upper surface 72 (FIG. 3) and defines an inverted trapezoidal or dovetail shaped boss 74 projecting upwardly therefrom and defining on either side thereof two stump receiving pockets 76 and 78. The pockets 76 and 78 are adapted to receive the detent stump 66 which, when positioned in a pocket 76 or 78, engages the boss 74 and locks the bolt 18 against being thrown or drawn. By positioning the levers 42 to align the gates 50 therein to receive the detent fence 52, thereby releasing the detent 40 and freeing the detent arms 58 and 62 to swing counter clockwise away from engagement of the stump 66 thereon with the boss 74, the bolt 18 is released or freed to slide under the influence of the operative engagement between the thrower tab 38 and talons 28 or 30 as the key is turned.

The boss 74 is of an inverted trapezoidal configuration and defines opposed downwardly and inwardly sloping surfaces 80 and 82. The stump 66 likewise is trapezoidal in configuration and defines downwardly and outwardly sloping surfaces 84 and 86. Engagement of a sloping surface on the boss 74 and a juxtaposed sloping surface on the stump 66, i.e., interfering engagement locks the detent 40 and further urges the detent arm 62 downwardly and thereby urges the cam rider 60 away from the cam surface 70 on the cam 24, and urges the detent fence 52 away from, instead of toward, the end surfaces of the levers 42. The slopes of the boss 74 and the stump 66 interferingly engage to form a dovetail contact.

Although shown and described as an inverted trapezoidal or dovetail shape, this shape and the respective angles are relative and thus alternative embodiments are possible. That is, an inward force applied to the bolt 18 causes a force to be transferred to the detent 40 at the point of contact. At this point of contact, the vector representing the force exerted by the bolt 18 on the detent 40 can be resolved into two orthogonal vectors: (a) a vector that is parallel with the vector of rotation for the detent, and (b) a vector that is perpendicular to the vector of rotation of the detent. Vector (b) has no effect on the rotation of the detent. Vector (a) determines the direction and magnitude of the rotational force applied to the detent. The lock is designed so that vector (a) contains a sufficient portion/fraction of the inward force and (a) is oriented so that the resulting force on the detent 40 will cause it to pivot in the counter clockwise direction, against the spring pressure of the spring(s) 46, and away from contact with the levers 42. Thus, the angle is with reference to a center line for the pivot of the detent. It is possible to design a lock that does not have this dove tail feature yet includes the features of the present invention, such as the detent shown in FIG. 10, as discussed below.

Figure 5B:
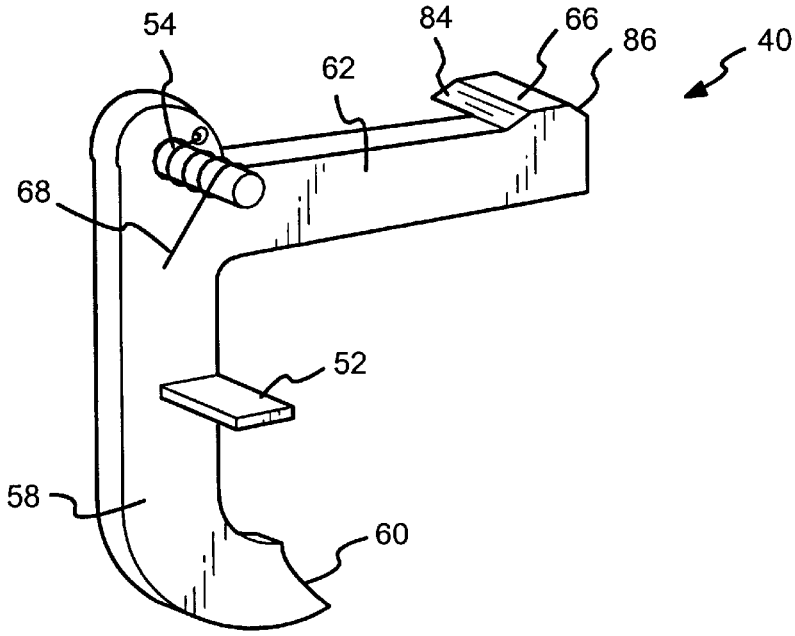
FIG. 5B is a perspective view of an alternative embodiment of a detent for the lock shown in FIG. 1.

A properly formed key (not shown) having appropriate slots and projections on its bit, when inserted in the key hole of the lock and turned to engage the levers 42, lifts each individual lever 42 to a certain position at which point the gate 50 in the forward edge of each lever 42 is aligned with other gates 50 to form a groove for receiving the detent fence 52. At this point, the detent 40 is biased to force the fence 52 into the groove by the detent biasing springs 46 and/or spring 68 (FIG. 5B). This movement of the detent releases the stump 66 from engagement with the bolt tail boss 74 and allows the thrower tab 38 to move the tail plate 22 to either throw or draw the bolt head 20 from the mortise.

Importantly however, before the fence is biased into the groove, another action must occur. As shown in FIGS. 4A–4C and FIGS. 6A–6D, the protrusion 74 must be moved a slight distance away from the stump 66, simultaneous with the alignment of the gates 50, to allow the biasing springs 46 to bias the fence 52 into the gates 50. Otherwise the boss protrusion 74 prevents stump 66 from moving thus preventing the fence from entering the gates.

Although shown and described as having the protrusion 74 attached to a movable bolt object in FIGS. 1–4, the lock may be designed where the pivot for the levers 44 is attached to the tail of the bolt (not shown). In such a lock, the pivot for the detent 56 is also attached to the bolt and protrusion 74 would then be attached to the lock case. The levers and detent move back and forth with the bolt. In such a design, protrusion or boss 74 would remain fixed and stump 66, pivotally attached to the bolt via 56 would then move.

Figure 4A:
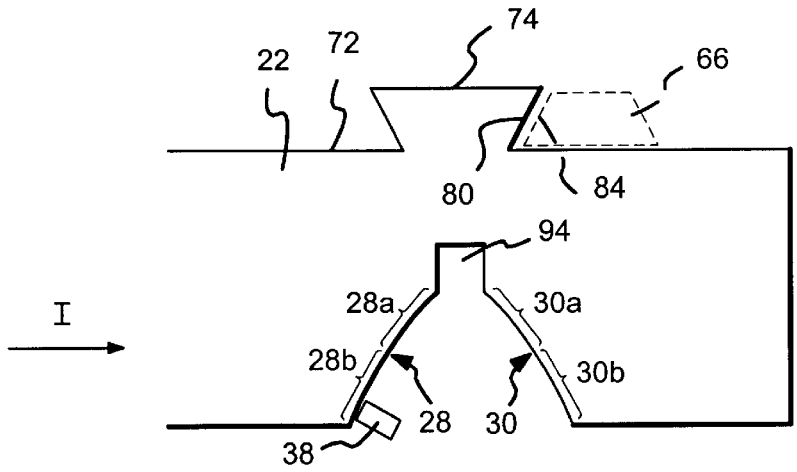
FIGS. 4A, 4B and 4C are expanded, front elevation views of the tail portion of the bolt shown in FIG. 3, expanded to illustrate details of the tail portion and its relationship to the detent at distinct stages during an opening event using the appropriate key.
Figure 4B:
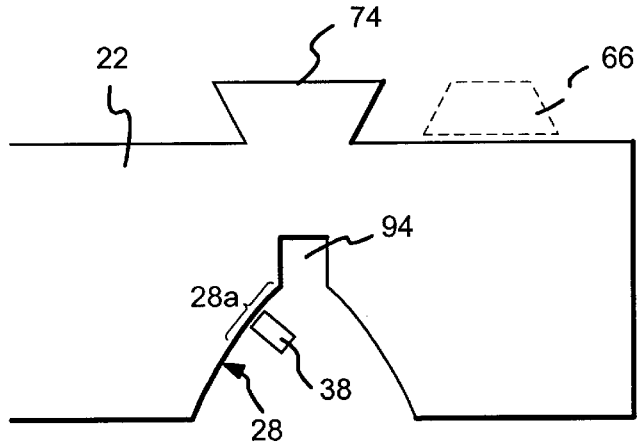

In an embodiment of the invention, as shown in FIG. 4A, the sloped portion 28 comprises at least two distinct regions, 28*a* and 28*b*. Region 28*a* has an angle and positional relationship to both the thrower 38 and the protrusion 74 such that as the thrower 38 is in sliding contact with the region 28*a*, the protrusion 74 is held so the detent can rotate. Region 28*a* may be curved to have a circular radius to achieve this function. The region 28*b* is angled or otherwise shaped, and positioned, so that when thrower 38 is in sliding contact with region 28*b*, the bolt tail 22 is actually forced, or camed outward or to the left as shown in FIG. 4B. Forcing the tail 22 in this direction forces the boss 74 away from the stump 66, which in turn, provides the clearance needed for the stump 66 to eventually swing (move counter-clockwise as shown). Allowing the stump to swing in this manner is necessary for the bolt to be able to slide in the unlocked direction.

Similarly, the sloped edge 30 also comprises two portions so that the thrower 38 can effectively force the boss 74 away from the stump 66 when sliding along 30*b*, and hold the boss in an "away" position when sliding along 30*a*.

Figure 4C:
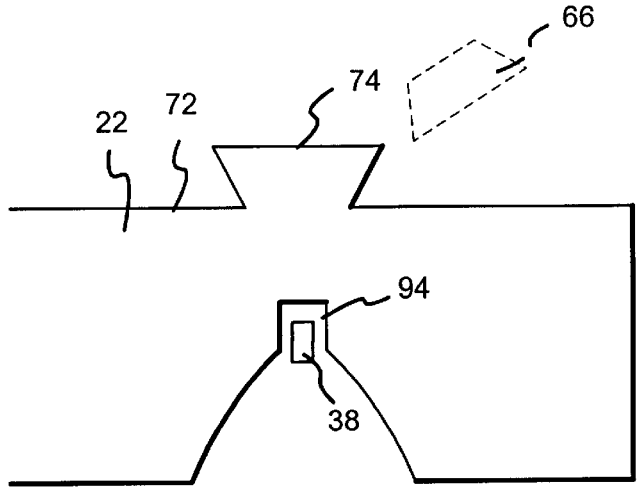

To illustrate the sliding action, assume that the lock is in locked position with the key removed, and that there is an inward force, I, exerting on the bolt. The cam 24 and detent 40 are, at this point, arranged as in FIG. 6A. The key is inserted and turned clockwise until the thrower 38 first contacts the tail 22 of the bolt 18 at the lower end of the linear portion, 28*b,* as shown in FIG. 4A. Until this position is reached, the stump 66 of the detent 40 is in contact with the boss 74 on the bolt. Here, edge 84 of the stump 66 on the detent is in contact with edge 80 on boss 74. This is illustrated in FIG. 4A by the location of stump 66 (shown in phantom). As the key turns further clockwise, the thrower 38 moves along the surface 28*b,* which forces/wedges the bolt outward (to the left relative to the stump 66, as shown). Once the thrower 38 has reached the point of intersection of 28*a* and 28*b,* the bolt has moved to the left a sufficient distance, as shown in FIG. 4B such that stump 66 can now clear boss 74 when the detent rotates counter clockwise. FIG. 4C illustrates this clearance as the detent rotated under the spring bias caused by springs 46 (FIG. 1).

Figure 6A:
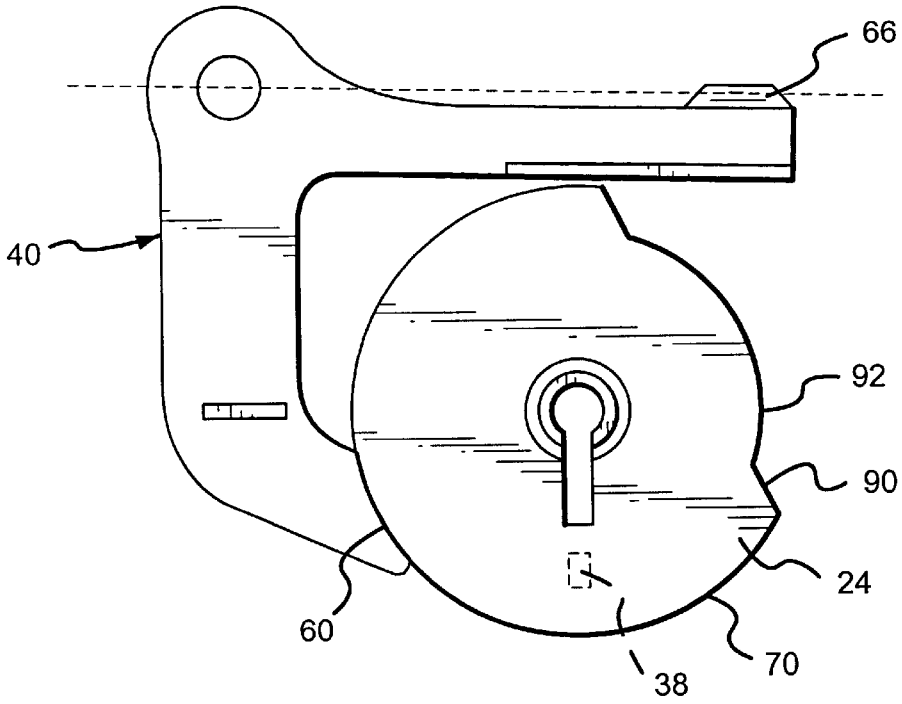
FIGS. 6A, 6B, 6C and 6D are front elevation views of the detent shown in FIG. 5A to illustrate details of the detent and its relationship to the cam shown in FIG. 1 at distinct stages during an opening event.
Figure 6B:
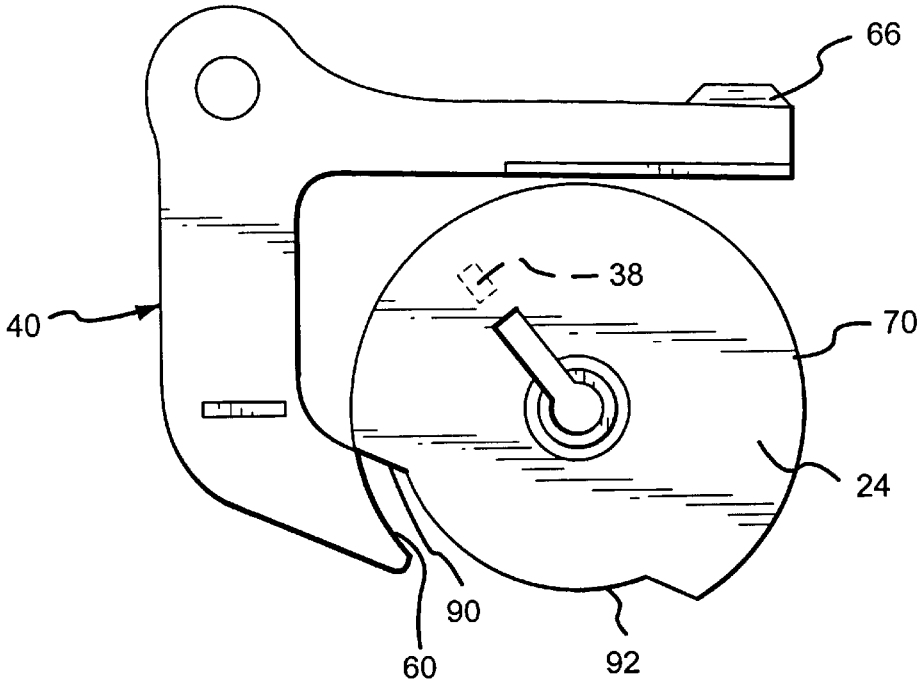
Figure 6C:
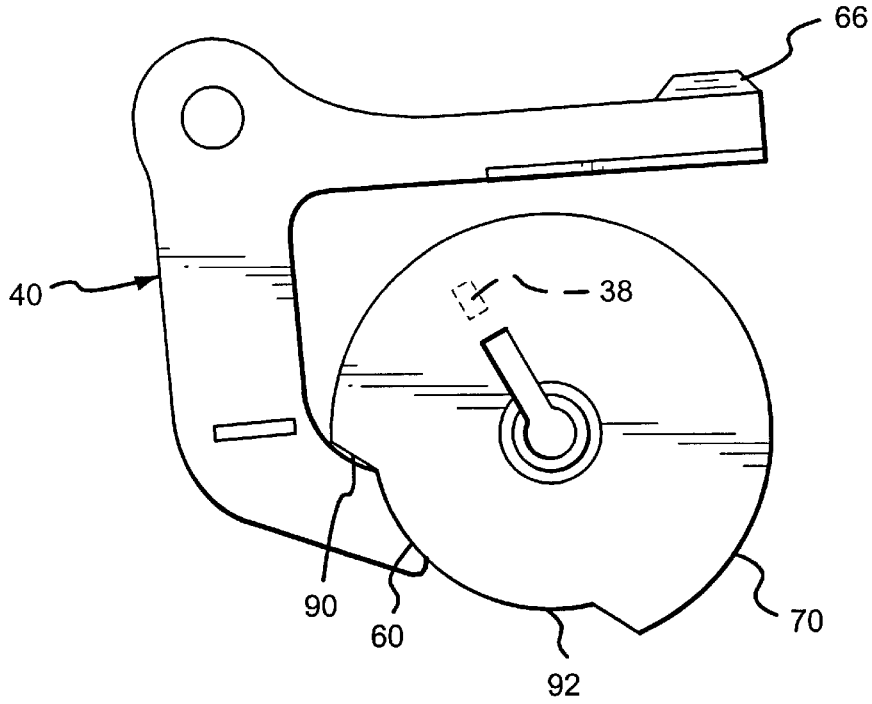

The cam 24 (FIG. 6A) has held the detent back until this point. That is, while the bolt 22 is being moved by thrower 38, the cam rider portion 60 of detent 40 is in contact with cam surface 70 which keeps the detent 40 from pivoting, as shown in FIG. 6A. Referring to FIG. 6B, as thrower 38 reaches the intersection of portion 28*b* and 28*a* of tail 22 (FIG. 4), then a further clockwise turning of the cam 24 causes the detent 40 to glide down surface 90 until the surface of rider 60 is in contact with surface 92 as shown in FIG. 6C. That is, cam rider 60 has been in contact with the larger diameter portion 70 of the cam 24 until the cam 24 rotates a sufficient amount, causing the rider to then come in contact with the transition surface 90. Until the rider 60 glides down surface 90, the fence 52 is held away from the levers 42, and the stump 66 of the detent 40 is held in its lower position, i.e., the position shown in FIG. 4B. During this process, the key also aligns the levers 42 so that the gates 50 are aligned with the fence 52. Indeed, if the key did not align the levers 42, the fence 52 would not slide into the gates 50 and the rider 60 would not rotate to move into contact with portion 92, as depicted in FIG. 6C.

Assuming the key aligned the levers 42, the key turns the cam 24 further clockwise and thrower 38 slides along surface 28*b* as shown in FIG. 4B while the detent moves from the position shown in FIG. 6B to the position shown in FIG. 6C. Again, this movement is made possible because the levers 42 have been aligned and the fence 52 enters the gates 50. Once the fence has moved into the gates, the relative positioning of the cam 24 and the detent 40 is as shown in FIG. 6C wherein the rider 60 follows along a smaller diameter surface 92. Accordingly, the stump 66 has moved relative to the boss 74, going from the position shown in FIG. 4B to the position shown in FIG. 4C.

As the key turns further clockwise (as shown), thrower 38 enters notch 94 (depicted in FIGS. 4A–4C) and throws the bolt to the right as it proceeds in its clockwise direction of turning. The final operation of the key (detent being forced down by cam, levers are lowered, key is removed) is relatively symmetrical with the above description. In an alternate embodiment, the lock maybe secured in the open position using less secure technology, e.g., prior art methods of maintaining the lock open as opposed to the more secure dual detent technology of the present invention since the extra security of the dual detent is primarily needed when the lock is in the locked position.

Figure 4D:
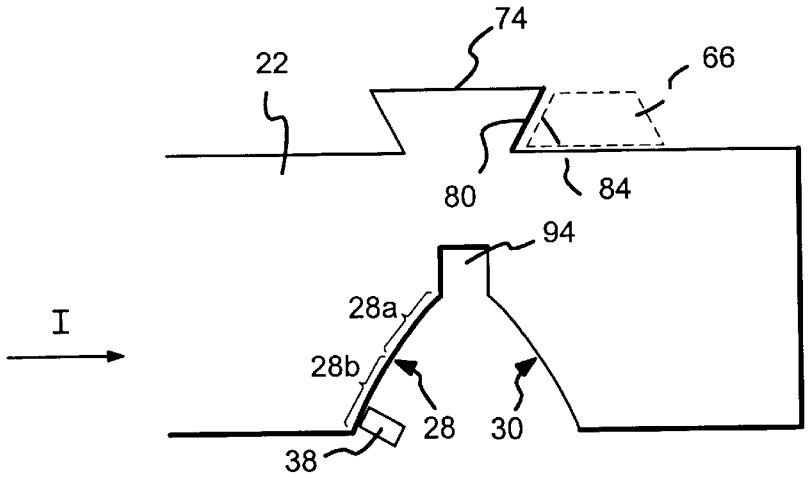
FIGS. 4D, 4E and 4F are expanded, front elevation views of the tail portion of the bolt shown in FIG. 3, expanded to illustrate details of the tail portion and its relationship to the detent at distinct stages during an attempted opening event using an inappropriate object, e.g., a pick or a blank key.
Figure 4E:
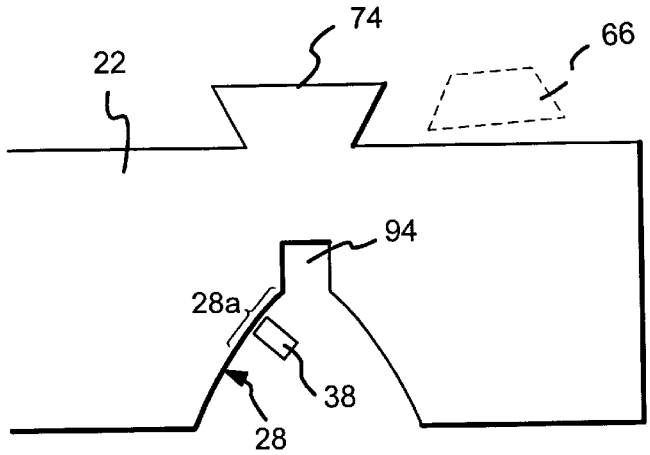
Figure 4F:
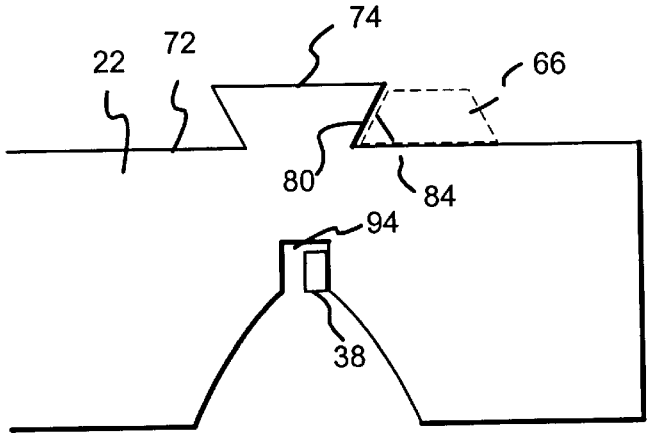

In the case of attack, as depicted in FIGS. 4D, 4E, and 4F, the cam is turned clockwise using either a blank key in the case of impressioning or with the use of some type of pick. With the thrower 38 at the upper end of 28*a,* the detent 40 is allowed to rotate a small amount (as shown in FIG. 4E) until the fence 52 contacts the far-left edge of the levers 42 (not shown). In this case, the detent 40 moves only a very small amount in the counter clockwise direction. Thus, the stump 66 remains essentially in the down position as shown in FIG. 4E. The force exerted by the fence 52 against the levers 42 is the spring force caused by springs 46 acting on the shelf-like protrusion 64 attached to the detent 40. This force is not sufficient to allow impressioning. The design prevents additional forces to act on the fence, such that the degree of force remains defined by the springs 46. This low force also makes it difficult to feel the gates 50 due to the significantly low friction caused by the fence 52 against the levers 42 in relation to the other frictional forces acting on the levers 42.

The protrusion 64 also acts as a spacer to stabilize the detent 40. Protrusion 64 stabilizes detent 40 by slidably contacting the lock housing (not shown). Although the protrusion 64 may touch the housing, it may not touch the housing at all times, it merely keeps the detent substantially in place. Indeed, the protrusion performs both the function of interacting with a spring to bias the detent in a predetermined direction and the function of stabilizing the detent. Prior art locks use more than one device to perform these functions.

Also, in an embodiment of the invention, an additional spring 96, shown in FIG. 2, causes friction between the levers by compressing the levers against the lock case to create friction between the levers and against the lock case. This friction masks the friction of the fence against the levers making the detection of the gates even more difficult.

Figure 6D:
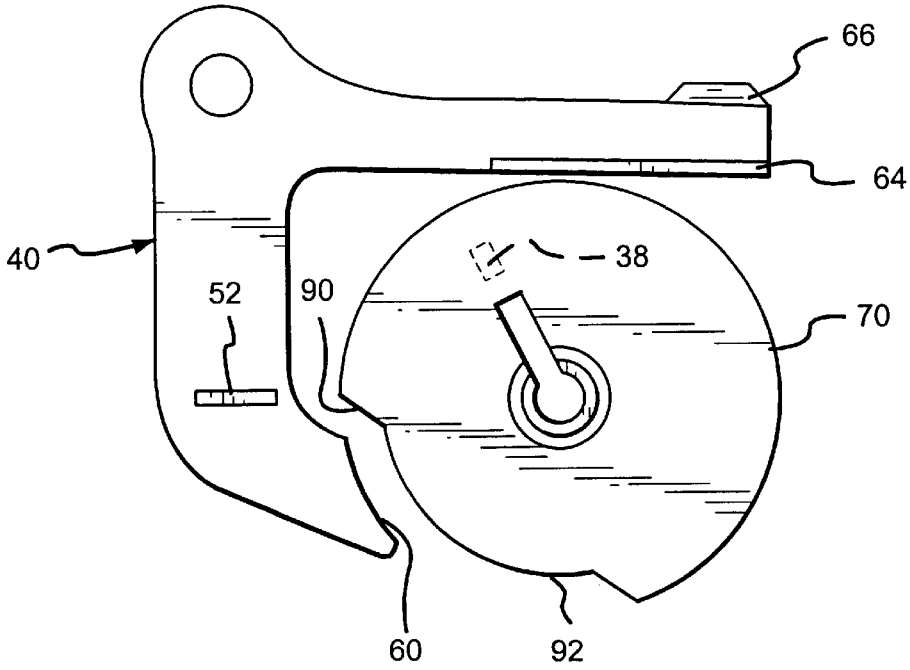

As the thrower 38 reaches the upper portion of 28*a,* and is about to enter notch 94, shown in FIG. 4E, the stump 66 is positioned in the relatively down position as shown in FIG. 4E. Moreover, since the proper key is not being used and the gates are not aligned, the detent and cam are positioned relative to each other as shown in FIG. 6D. In this position, rider 60 is not in contact with the cam 24 because the gates are not aligned such that the fence 52 contacts the levers 42 thus holding the detent down in locked position.

When picking, spring pressure does not produce enough friction between 52 and 42 to allow the levers to stay in position. Therefore, when picking, each lever must be held up independently. Also, friction between 42 and 52 is small versus the other frictions, such as from spring 96, making it difficult to "feel" the gates.

If the cam 24 is turned further clockwise, then the thrower 38 will enter notch 94 and contact the right side of 94 as shown in FIG. 4F. In prior art designs, clockwise turning pressure of the cam 24 at this point causes the thrower 38 to transfer this pressure to the fence against the levers 42. In the present invention however, this clockwise turning pressure forces the bolt tail 22 toward the right (as shown in FIG. 4F) causing the face 80 of boss 74 to contact the face 84 on the stump 66 on the detent. Further pressure exerted by the would-be attacker on the bolt causes the detent to rotate clockwise about point 54 (FIG. 5A) causing the fence 52 to actually move away from contact with the levers to thereby prevent impressioning, picking or fence breaking.

Alternative attack methods may apply inward pressure on the bolt as per I (FIG. 4A). In this position, the fence is away from the levers. Thus, the lock is secure with all the pressure taken up by the detent between the stump 66 and the pivot 54. There is no pressure on the fence at this point. The downward portion of the L-shaped detent, 40, merely "floats" within the lock case and does not take up any of the pressure applied to the bolt. Since the pressure of springs 46 is not sufficient to break the fence, and since continued pressure moves the fence away from the levers, this eliminates the possibility of fence breaking.

When someone endeavors to open the lock without using a key, the conventional procedure is to push the bolt head towards the unlocked position with sufficient force to hold the fence against the edge surfaces of the levers 42. According to the present invention, the sloping surfaces on the boss 74 and stump 66 with respect to the center line cause pressure or force on the bolt towards the unlock position to preclude the detent fence 52 from riding against the levers 42, thus preventing opening of the lock by feeling or sensing the position of the levers 42 and their respective gates 50.

Figure 7:
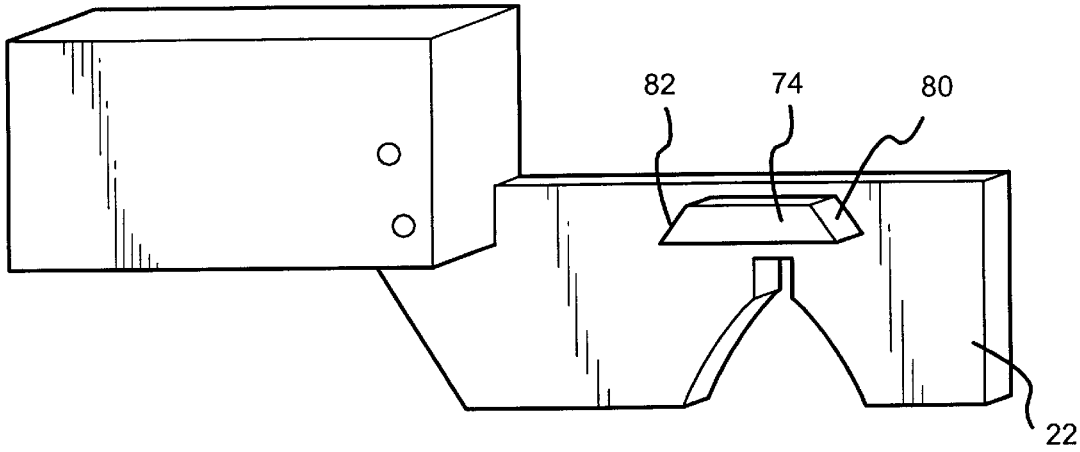
FIG. 7 depicts a bolt mechanism for an alternative embodiment of the present invention.

FIGS. 7 and 8 provide an alternative embodiment incorporating aspects of the present invention. FIG. 7 illustrates the tail portion 22 of the bolt having boss 74. In this particular embodiment, boss 74 protrudes out from the tail portion 22 towards the detent, instead of upwards from the upper surface of the tail 22 as shown in FIG. 4. Boss 74 (FIG. 7) is an inverted trapezoidal configuration and defines opposed downwardly and inwardly sloping surfaces 80 and 82.

Figure 8A:
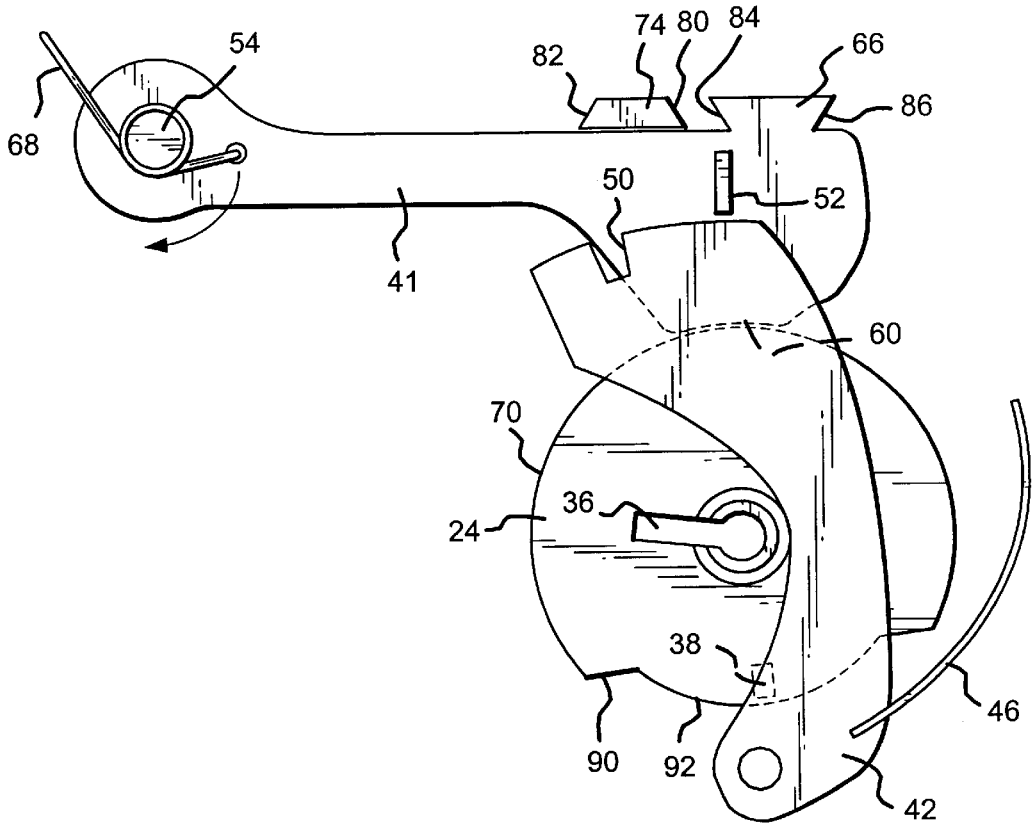
FIGS. 8A, 8B and 8C depict alternative embodiments of a detent that incorporates aspects of the present invention.

In an embodiment, boss 74 operates in combination with detent 41 shown in FIG. 8A. In this case, detent 41 is not L-shaped as is detent 40 shown in FIGS. 5 and 6. Indeed, the detent 41 in FIG. 8A, has a single arm and moves in the opposite direction as compared to the detent 40, shown and described above in conjunction with FIGS. 5 and 6. That is, the detent 41 moves clockwise (as shown) when the lock is opened by the correct key and it moves counter clockwise (as shown) when the lock is attacked. Spring 68 biases the detent into an unlocked position so that when the gate(s) 50 are aligned, fence 52 is moves downward (as shown) into the gates. Thrower 38 is in an alternate orientation with respect to the keyhole 36 in this particular embodiment to allow the levers to be properly raised or positioned prior to throwing the bolt to a new position. Additionally, since boss 74 protrudes from tail 22, protrusion 66 need not extend into the bolt layer. Importantly, the detent 41 moves counter-clockwise and away from the levers 42 when an inward force is applied to the bolt (as shown).

Figure 8B:
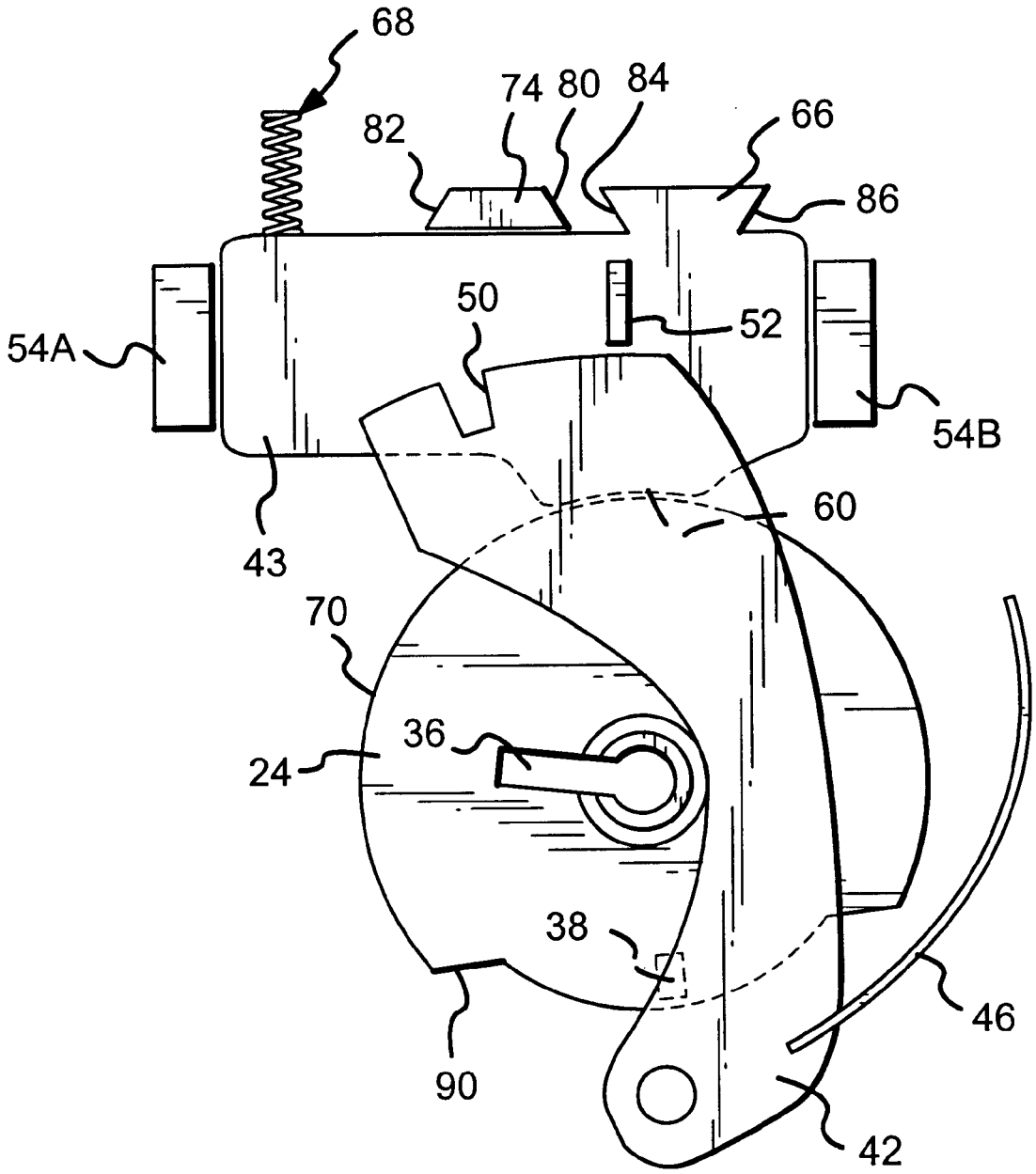
Figure 8C:
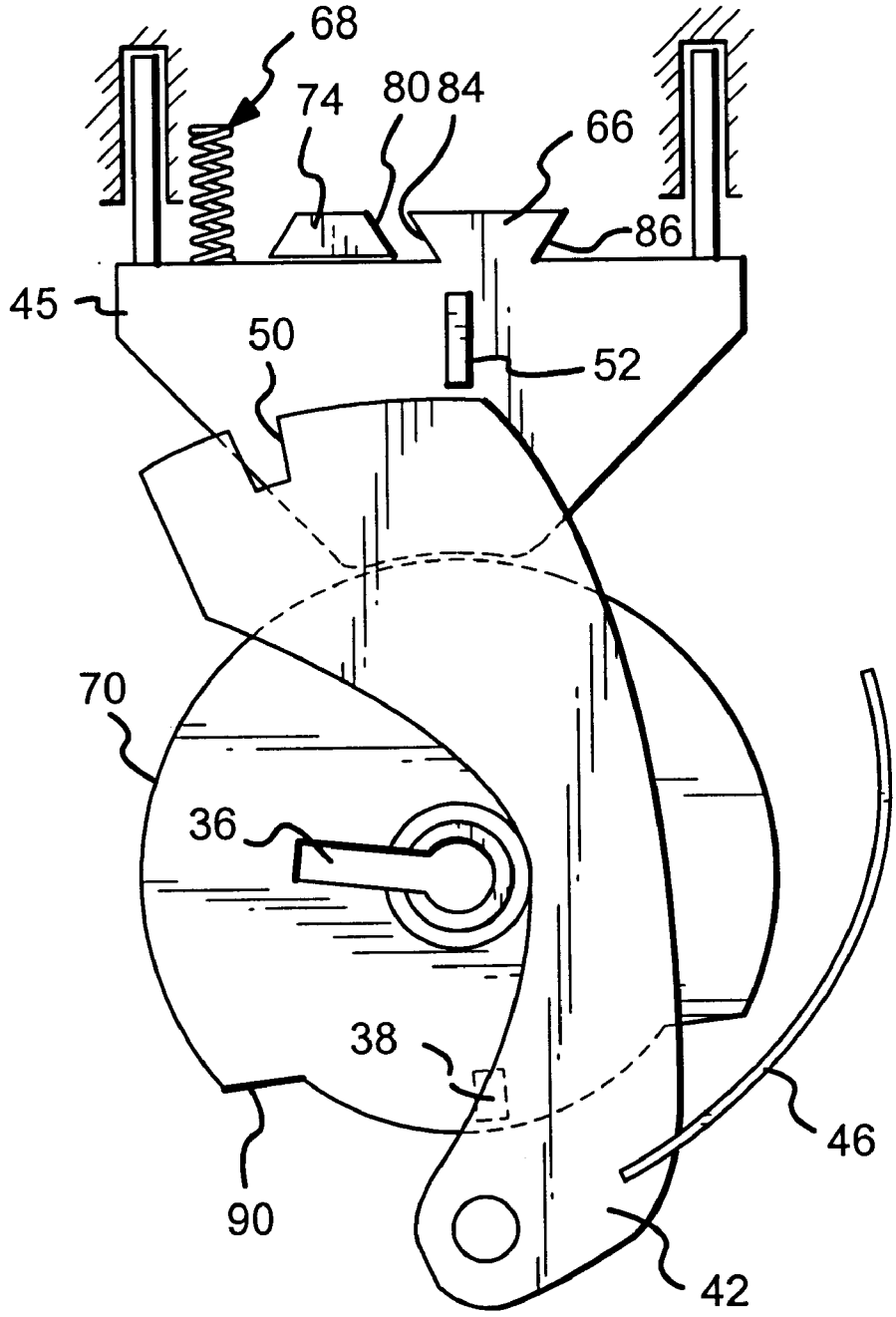

FIGS. 8B and 8C illustrate two additional detent embodiments 43 and 45 having similar characteristics of detent 41 shown in FIG. 8A. Essentially, each is biased by spring 68 so that the detents 43 and 45 move downward when the gates are properly aligned. However, each detent 43 and 45 has a protrusion 66 with sloped sides 84 and 86 that contact boss 74 such that the detent moves away from the levers 42 when a force is applied to the bolt. Additionally, detent 45 moves linearly, as opposed to rotating about a pivot point.

Figure 9:
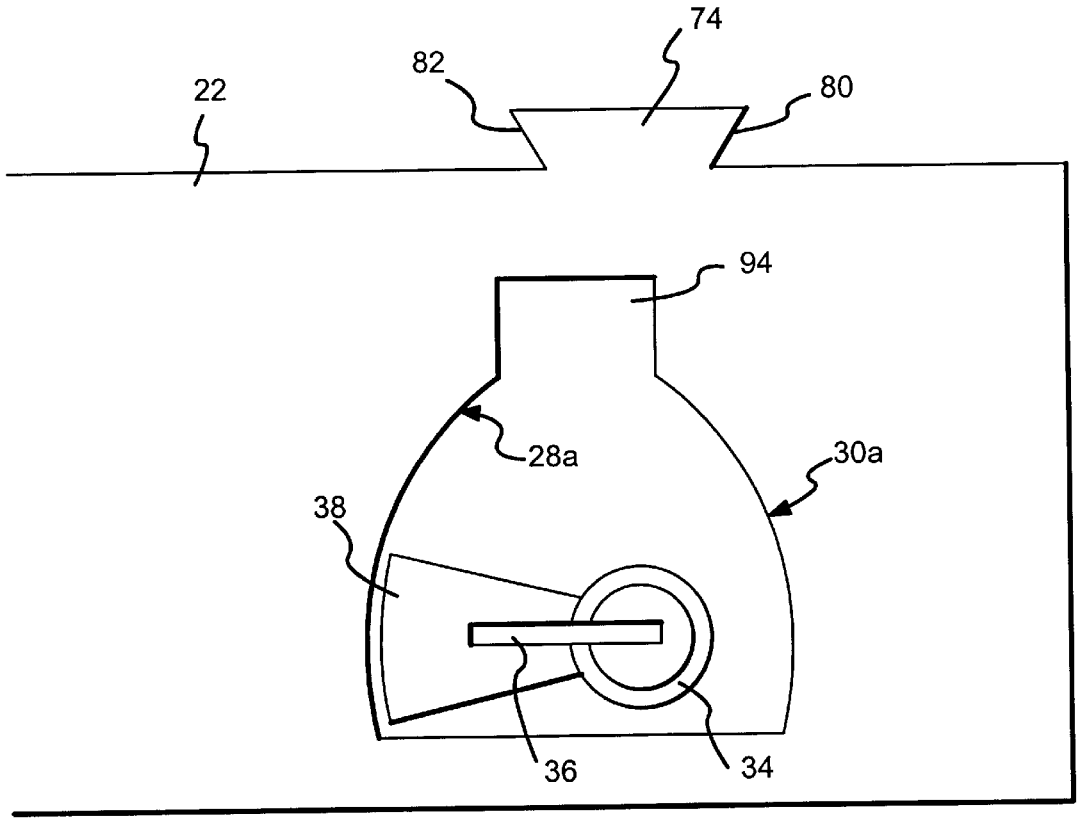
FIG. 9 is an expanded, front elevation view of an alternative embodiment of the tail portion of the bolt and cam mechanism shown in FIG. 2.

FIG. 9 illustrates yet another embodiment of the present invention which may be used in higher security situations such as for safes, vaults, jails, safety deposit boxes, etc. The key does not turn a full 360° but only turns 180° from left to right. In this embodiment, the portion 28*b*, shown in FIG. 4A, is not required. Instead, the curved portion 28*a* is extended farther down so that the thrower 38 holds the bolt in the position indicated in FIG. 4B with the detent stump 66 being held away from the boss 74 on the bolt. In this embodiment, the bolt is not wedged/forced outward but is rather simply held in the position of FIG. 4B. The thrower, 38, moves along surface 28*a* and holds the bolt in this outward position while the levers are being aligned and while the detent pivots into the unlocked position. The thrower is then allowed to enter 94 and throw the bolt to the right (as shown).

Figure 10A:
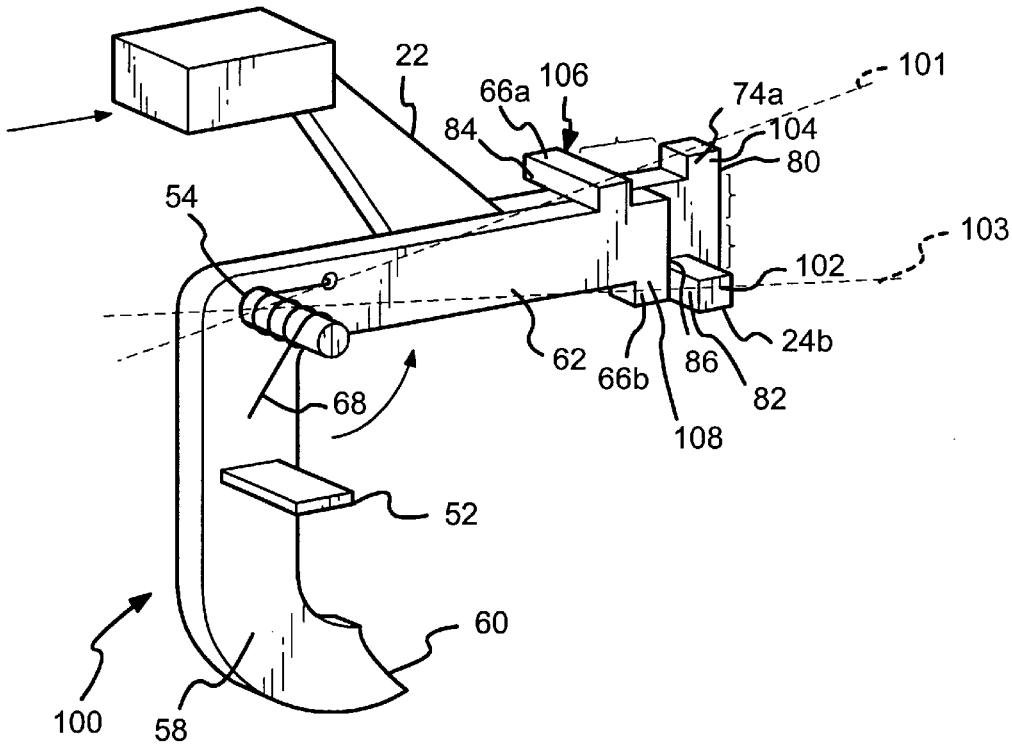
FIGS. 10A and 10C depict a detent for an alternative embodiment of the present invention at distinct stages of operation.
Figure 10B:
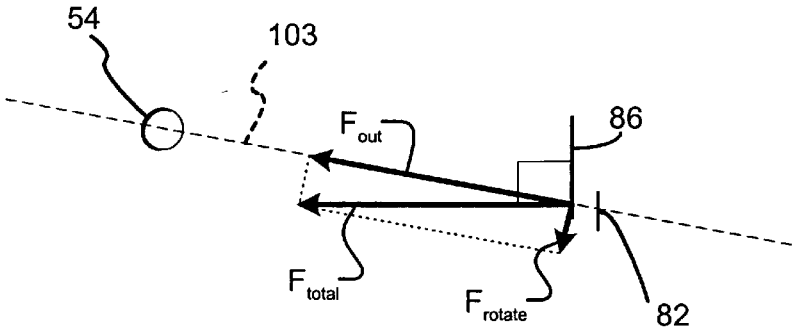
FIGS. 10B and 10D depict force diagrams for the alternative embodiment shown in FIGS. 10A and 10C, respectively.

FIGS. 10A, 10B, 10C and 10D illustrate an alternative detent 100 and some of its functional details that might replace detent 40 for another embodiment of the present invention wherein the dovetail shape of the boss 74 and stump 66 are split to form 102, 104, 106 and 108. In this embodiment, there is a protrusion 102 on the bolt 18. Extension 104 interacts with stump 106 when the lock is locked (FIGS. 10C and 10D) while extension 108 interacts with protrusion 102 when the lock is unlocked (FIGS. 10A and 10B.) Thus, a dove tail/bevel is not necessary, but only how the relative forces interact in the design to produce the desired result. Importantly, the angles relative to the center-lines 101 and 103 of the arms 62 of detent 100 and 40 (FIG. 6A) have the same relationship. To obtain detent 100 shown in FIG. 10, surfaces 84 and 80 (FIGS. 3 and 5B) are conceptually rotated about the pivot 54 a few degrees counter clockwise while surfaces 82 and 86 in FIGS. 3 and 5B were rotated about the pivot 54 a few degrees clockwise.

Figure 10C:
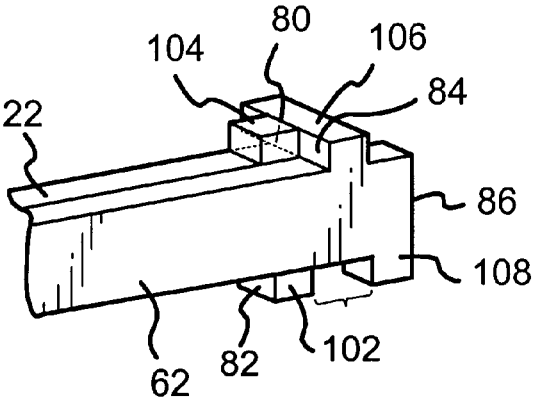
Figure 10D:
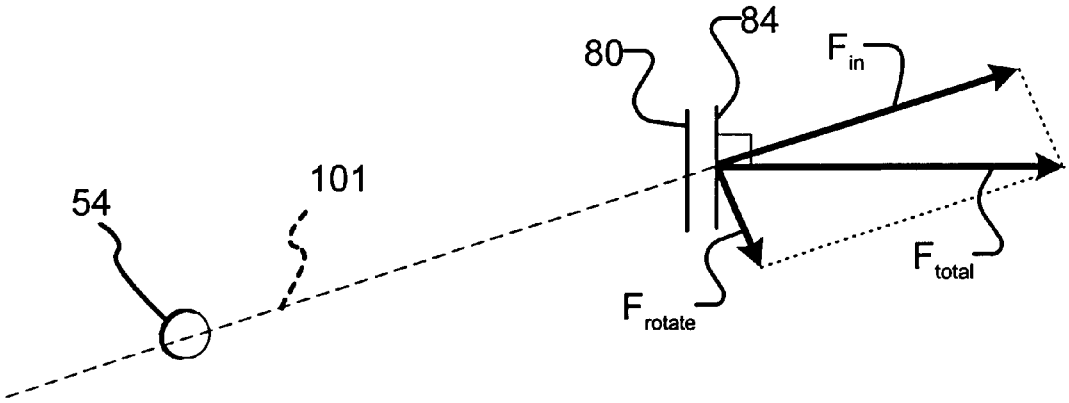

FIG. 10C illustrates the relative positioning of 102, 104, 106 and 108 while the lock is in a locked position. As is shown in FIG. 10D, should a force $F_{total}$ be applied to the bolt, object 104 would contact 106 such that the detent would actually pivot the fence 52 away from the levers (not shown) in the direction Of $F_{rotate}$. In this case, the force on the bolt, $F_{total}$, is resolved into two forces, $F_{in}$ and $F_{rotate}$. Force $F_{rotate}$ causes the detent to rotate while $F_{in}$ is exerted against pivot 56 preventing the locks from opening. FIG. 10A illustrates the relative positions when the lock is in the open position and correspondingly FIG. 10B illustrates the forces acting on the detent when the bolt is forced in the outward direction. Thus, detent 100 operates in a manner similar to detent 40 in FIG. 1, wherein only the relative positions of some of the parts have changed. 13 The approach to solving the problem of unauthorized opening of the lock provided by the present invention is quite different from the prior art. Here, a dual-action detent is used to take away the control an attacker of the lock has on the amount of pressure the fence exerts against the levers. This effectively hinders all the above methods of attack simultaneously. In the present invention, the force exerted by the fence against the levers is limited to the force exerted by a spring internal to the lock mechanism itself and, as such, is predetermined by the design engineers. This force is sufficient enough to allow the lock to open when the correct key is inserted. This is the primary action of the detent. However, when exerting an inward force ($F_{total}$ shown in FIG. 10D) on the bolt in an attempt to defeat the lock, the detent is forced to rotate in the opposite direction (along $F_{rotate}$ as shown in FIG. 10D), i.e., the fence moves away from the levers. Therefore, this dual-action of the detent causes the fence to move away from the levers when an inward force is applied. Instead of the force on the bolt being directly transmitted to the levers via the fence, the force is taken up entirely by the detent. Thus, the only force exerted by the fence on the levers is due to the internal spring.

Picking is made difficult by this dual-action detent because the force exerted by the spring is not sufficient to hold the levers up. The feel of the gates is also easier to mask because the pressure the fence exerts against the levers is fixed at the factory. Adding a spring to compress the stack of levers is very effective here. It can be used to increase the friction between the levers to such a level that it completely masks the pressure exerted by the fence against the levers.

In an embodiment, frictional masking means are added to the lock that result in other frictional components that are greater than the friction of fence against lever end, which significantly impacts the ability to pick the lock. These frictional masking means thus perform at least one of the following two functions: 1) increase or create other lever frictional components apart from fence-lever friction or 2) decrease fence-lever friction. To increase the lever frictions, the faces of the levers 42 can be made rougher to increase the friction between the levers (not shown). The rougher faces of the levers still slide relatively smoothly when operated with the appropriate key, yet the face is slightly roughed to increase the frictional component and hamper the picking of the lock.

Figure 11A:
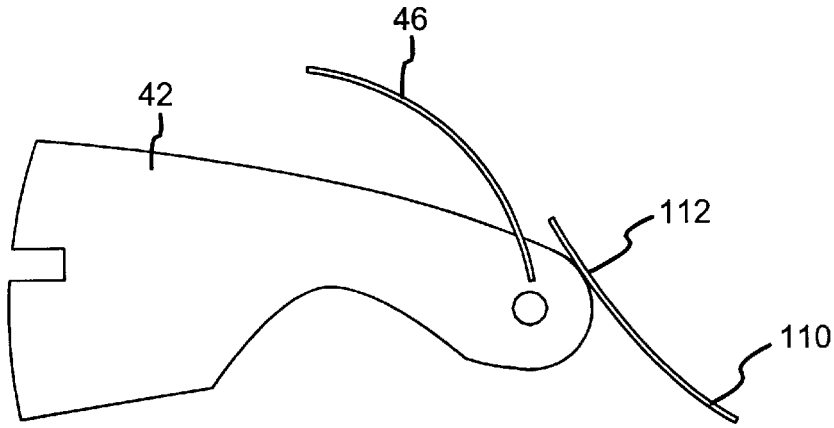
FIGS. 11A, 11B and 11C depict various uses of springs to increase the frictional components exerted on the levers of the lock shown in FIG. 1.
Figure 11B:
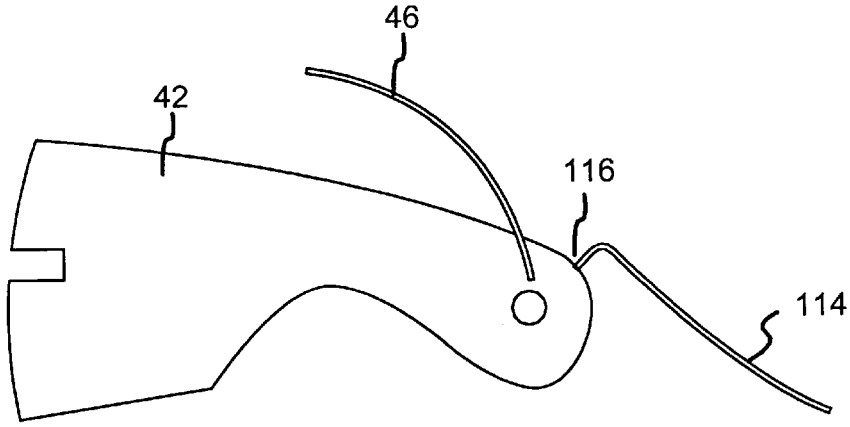
Figure 11C:
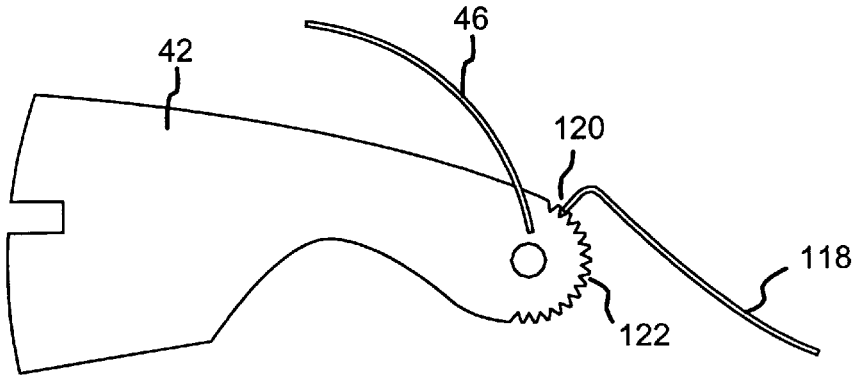

Alternatively, the frictional masking means may relate to one or more of springs 110, 114 and 118 as in FIGS. 11A, 11B and 11C respectively may be added to increase the frictional forces on the levers 42. In FIG. 11A, spring 110 creates friction on the lever at point 112. In FIG. 11B, the end of spring 114 creates more of a grinding type friction. In FIG. 11C, the edge of the lever 122 is rough or jagged such that spring 118 a makes a stronger grinding or clicking at 120. In FIGS. 11A, 11B and 11C, one spring can be used for all levers, or one spring can be used for each individual lever. The use of springs 110, 114 and 118 effectively masks/disguises the feel of the gates. Yet other frictional masking means that increase lever frictional components, independent of the fence-lever frictional components, may also be added.

Other frictional masking means may relate to decreasing fence-lever friction. To decrease the fence-lever friction, the movement of the fence (at the point of contact with the levers) is made perpendicular to the movement of the levers, which pivot around the pivot point 44. This helps minimize the frictional force. Next, the edge of the levers and the fence (the parts that are in contact) are made smooth to eliminate any "bumps", etc. that would cause friction. This edge can also be lubricated to further reduce friction. In an embodiment, metal having impregnated oil that keeps a constant lubrication is used to reduce the friction.

Also, since it is not possible to make all the levers have exactly the same diameter it may be possible that there will be a "ledge" at the gates and false gates. To eliminate this problem, the levers are rounded, beveled or otherwise shaped slightly near the gates and false gates to ensure that there is a smooth transition as the fence goes past the gate or false gate.

In previous designs, it was always possible to increase the pressure the fence exerts against the levers to overcome any other friction imposed on the levers and thus detect the gates. In the present invention, the friction of the fence against the levers is determined by the spring bias. Thus, while a would-be attacker of prior-art lever locks could always increase this friction by simply increasing the force the fence exerts on the levers, this is not possible in the present invention.

By increasing the magnitude of the other frictional components that act on the levers as compared to the magnitude of the friction of the fence against the levers, the present invention prevents the attacker from feeling the gates. For example, assuming that an attacker can feel the gates if the friction of the fence against the levers is 10% or greater when compared to all other frictions on the lever. For current designs, all the would-be attacker needs to do is increase the pressure he exerts on the fence against the levers until a 10% or greater friction is obtained. However, in an embodiment of the invention, the relative friction factors can be adjusted until a maximum force of less than the 10% is reached.

Additionally, impressioning is essentially impossible because the friction of the fence against the levers due to the force exerted by the spring is very small and can be minimized by the design of the lock. The force of the fence against the levers can be made perpendicular to the movement of the levers themselves, thus limiting the force to frictional effects only. Any marks left on the key due to a lever not being at a gate are indistinguishable from the marks left by the levers themselves due to the force of the lever spring and the friction between the levers. Fence breaking is impossible because the fence can easily be made strong enough to withstand the pressure exerted by the spring on the detent. Many of the above mentioned ideas for hindering attack could also be incorporated with this design. False gates, tail of monitor lever, detector lever, etc. can all be added to this design to increase the difficulty of attack.

While certain illustrative embodiments of the present invention have been shown in the drawings and described above in considerable detail, it should be understood that there is no intention to limit the invention to the specific forms disclosed. For example, the invention may be used in both new locks and be implemented as a modification to existing locks. Therefore, the intention is to cover all modifications, alternative constructions, equivalents and uses falling within the spirit and scope of the invention as expressed in the appended claims.

What is claimed is:

1. A key actuated lever lock comprising:

a bolt apparatus adapted to be slidable between a locked position and an unlocked position, the bolt having a boss;

a plurality of levers, wherein each lever comprises a gate, and wherein the gates are alignable;

a movable detent apparatus having a fence, the fence being biased to move into the gates when the gates are aligned;

a stump positioned on the movable detent, the stump being in interfering engagement with the boss when a force is applied to the bolt while the gates are not aligned, and where the interfering engagement maintains the fence away from the levers; and a thrower mechanism that engages the bolt and forces the boss away from the stump thereby freeing the detent to move when the gates are aligned.

2. A key actuated lever lock as defined in claim 1 wherein the detent is L-shaped and pivots about a detent pivot point.

3. A key actuated lever lock as defined in claim 1 wherein the detent comprises a single arm that pivots about a detent pivot point.

4. A key actuated lever lock as defined in claim 1 further comprising:

a case wherein the bolt in said case adapted to be thrown between the locked position and the unlocked position by an appropriate key;

the bolt further comprising a bolt head adapted for locking engagement in a mortise and a bolt tail plate extending from the bolt head and wherein the bolt tail plate defines a notch extending into the plate and opening into a lower edge, wherein the notch defines opposed talons integral with and depending from said tail plate, said plate defining a pair of spaced notches in an upper edge separated by the boss;

wherein the detent is L-shaped and is pivotally mounted on a detent pivot in said case and defines a depending arm having a cam rider formed thereon;

a detent cam rotatably mounted in said case;

a spring biasing said detent to hold said cam rider against said detent cam;

the detent further defining an elongated laterally extending tail defining an upper edge;

wherein the stump is integral with said laterally extending detent tail and extending laterally from said upper edge and defining opposed downwardly and outwardly sloping surfaces;

the stump being adapted to be selectively received in said spaced notches with a sloping edge of said stump in interference engagement with a corresponding sloping edge of said boss; and a key actuated mechanism for rotating said detent cam to release said detent for spring biased pivoting movement about said detent pivot to release said stump from engagement with said boss and for engaging said talons to throw said bolt, and wherein an external force on the bolt in the unlock direction causes said boss to act on said stump to exert a rotation force on said detent tail urging detent fence away from the levers.

5. A lock as defined in claim 1 further comprising a frictional masking means for increasing lever frictional components independent of any fence-lever frictional component.

6. A lock as defined in claim 5 wherein the frictional masking means comprising levers having relatively rough faces.

7. A lock as defined in claim 5 wherein the frictional masking means comprises at least one spring that contacts the levers.

8. A key actuated lever lock as defined in claim 1 wherein the bolt comprises a bolt head and a bolt tail plate extending from the bolt head and wherein the bolt tail plate defines a notch extending into the bolt tail plate, wherein the notch defines opposed talons integral with and depending from said bolt tail plate wherein at least one of the talons comprises a first portion that engages the thrower mechanism which forces the boss away from the stump thereby freeing the detent to move when the gates are aligned, the one said talon further comprising:

a second portion that maintains the boss away from the stump while the detent moves to free the stump from interfering engagement with the boss as the fence simultaneously moves to the gates.

9. A key actuated lever lock as defined in claim 1 wherein the tail bolt further comprises a plurality of bosses.

10. A key actuated lever lock as defined in claim 1 further comprising a plurality of stumps.

11. A key actuated lever lock comprising:

a bolt apparatus adapted to be slidable between a locked position and an unlocked position, the bolt having a boss;

a plurality of levers, wherein each lever comprises a gate, and wherein the gate are alignable;

a movable detent apparatus having a fence, the fence being biased to move into the gates when the gates are aligned; and a stump positioned on the movable detent, the stump being in interfering engagement with the boss when a force is applied to the bolt while the gates are not aligned, and where the interfering engagement maintains the fence away from the levers, wherein the force creating the interfering engagement moves the fence further away from the levers.

12. A key actuated lever lock as defined in claim 11, further comprising:

a second boss located on the bolt tail; and a second stump located on the movable detent and adapted to be interferingly engaged with the second boss when the lock is in a unlocked position.

13. A key actuated lever lock as defined in claim 11 wherein the detent moves linearly.

14. A key actuated lever lock comprising:

a bolt apparatus adapted to be slidable between a locked position and an unlocked position, the bolt having a boss;

a plurality of levers, wherein each lever comprises a gate, and wherein the gates are alignable;

a movable detent apparatus having a fence, the fence being biased to move into the gates when the gates are aligned; and a stump positioned on the movable detent, the stump being in interfering engagement with the boss when a force is applied to the bolt while the gates are not aligned, and where the interfering engagement maintains the fence away from the levers, wherein the boss and stump are substantially trapezoidal, the interfering engagement between the boss and stump forms a dovetail contact.

15. A method of thwarting efforts to open without a key a sliding bolt lock comprising a sliding bolt having a boss, a plurality of levers each comprising a gate, and a movable detent apparatus having a fence that is biased to move into the gates when the gates are aligned, the method comprising:

moving the fence away from the levers by an interfering engagement between a stump positioned on the movable detent apparatus and the boss when a force is applied to the bolt while the gates are not aligned.

* * * * *

UNITED STATES PATENT AND TRADEMARK OFFICE

CERTIFICATE OF CORRECTION

PATENT NO. : 6,698,259 B2
DATED : March 2, 2004
INVENTOR(S) : MacMillan

It is certified that error appears in the above-identified patent and that said Letters Patent is hereby corrected as shown below:

Column 10,
Line 35, delete “13” after “parts have changed.”

Column 13,
Line 48, delete “to” and replace with -- into --

Signed and Sealed this

Third Day of August, 2004

JON W. DUDAS
*Acting Director of the United States Patent and Trademark Office*